US006113096A

United States Patent [19]

Simmons

[11] Patent Number: 6,113,096

[45] Date of Patent: Sep. 5, 2000

[54] BASEBALL CARD BOARD GAME

[76] Inventor: James R. Simmons, 364 Trailview Rd., Encinitas, Calif. 92024

[21] Appl. No.: 08/916,548

[22] Filed: Aug. 22, 1997

[51] Int. Cl.[7] ..... A63B 67/00

[52] U.S. Cl. ..... 273/108.31; 273/108.3

[58] Field of Search ..... 273/108.1, 108.3, 273/108.31, 108.32, 236, 244, 244.1

[56] References Cited

U.S. PATENT DOCUMENTS

| | | | |
|---|---|---|---|
| 1,269,886 | 6/1918 | Watkins | 273/108.32 |
| 1,532,708 | 4/1925 | Moore | 273/108.31 |
| 1,590,264 | 6/1926 | Sweigart | 273/108.31 |
| 1,642,093 | 9/1927 | Stewart | 273/108.32 |
| 2,672,343 | 3/1954 | Augier | 273/108.32 |
| 2,742,290 | 4/1956 | Fasana . | |
| 2,980,427 | 4/1961 | Cragg | 273/108.32 |
| 3,534,962 | 10/1970 | Singleman | 273/108.32 |
| 3,576,325 | 4/1971 | Naturale | 273/108.31 |
| 4,017,074 | 4/1977 | Roberts | 273/108.31 |
| 4,179,123 | 12/1979 | Tsukuda . | |
| 4,210,335 | 7/1980 | Licciardi . | |
| 4,230,316 | 10/1980 | Harper . | |
| 4,261,569 | 4/1981 | Frohlich . | |
| 4,452,453 | 6/1984 | Daley et al. . | |
| 4,634,125 | 1/1987 | Seklecki . | |
| 4,687,199 | 8/1987 | Aguirregomezcorta . | |
| 5,087,050 | 2/1992 | Donovan . | |
| 5,092,596 | 3/1992 | Bucaria . | |
| 5,129,651 | 7/1992 | Tobia, Jr. . | |
| 5,137,279 | 8/1992 | Murphy et al. . | |
| 5,183,266 | 2/1993 | Kohler | 273/108.32 |
| 5,201,520 | 4/1993 | Castle et al. . | |
| 5,251,904 | 10/1993 | Cruz . | |
| 5,390,933 | 2/1995 | Kraus . | |
| 5,407,204 | 4/1995 | Meyer, III . | |

*Primary Examiner*—Raleigh W. Chiu

[57] ABSTRACT

The present invention in a particular embodiment can be characterized as a method of determining an outcome in a baseball game by determining an out in the event a ball is hit against one of a plurality of player cards; and determining a hit in the event the ball is not hit against one of the player cards, but rather is hit and comes to rest within a predetermined distance of one of the plurality of player cards. In a further embodiment, the present invention can be characterized as a baseball game employing a bat; a ball; a plurality of player cards, the baseball player cards including a baseball player card (or baseball trading card), and a player card stand, the baseball player card being separable from the player card stand to measure a number of baseball player card lengths from said player card stand that the ball comes to rest after being hit by the bat; and a game board including a baseball diamond thereon.

5 Claims, 4 Drawing Sheets

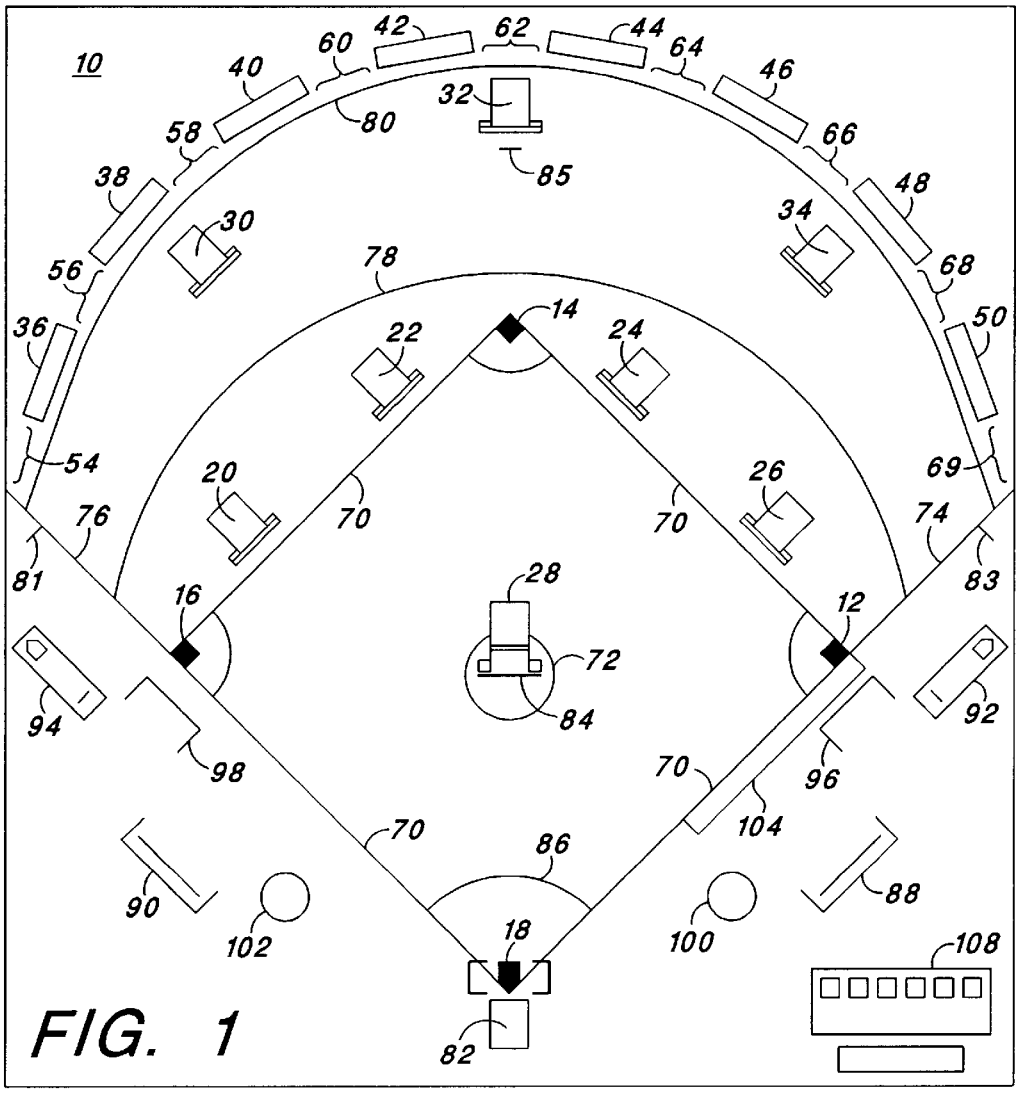
FIG. 1
FIG. 2
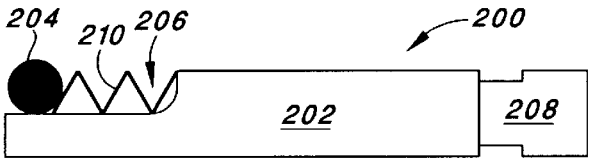
FIG. 3
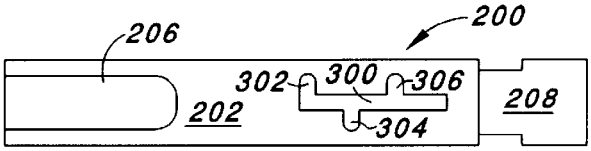
FIG. 4
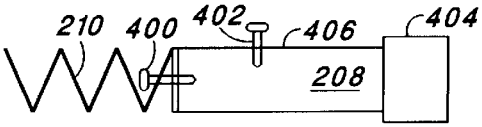

108
612
614
616
618
620
622
600
602
604
606
608
610
RUNS VISITING TEAM
INNING
OUTS
RUNS HOME TEAM
STRIKES
BALLS

900

1000

800

28
706
700
702
704

BASEBALL CARD BOARD GAME

BACKGROUND OF THE INVENTION

The present invention relates to a baseball card board game, and more particularly to such game including a method for determining hits based on a number of baseball card lengths from a defensive baseball card that a ball is hit by an offensive player.

The use of games is known in the prior art. More specifically, games heretofore devised and utilized for the purpose of simulating the game of baseball. For example, a baseball board game is illustrated in U.S. Pat. No. 4,261,569 (Frohlich) that comprises a game board having a baseball diamond thereon, a random number generator in the form of a pair of differently colored dice, and a plurality of ball player cards including at least one pitcher and batter. The action is controlled by generation of random numbers and looking to the cards to determine, in accordance with the number generated, the batter's performance and a base runner's movement. The instructions on the cards are written so as to simulate the actual major league performance of the player whose name appears on it.

Another patent of interest is U.S. Pat. No. 4,230,316, which teaches a method of playing a baseball board game. The board game is played on a game board carrying colored indicia thereon and a predetermined play action surface area and non-action surface area. A game piece carrying indicia thereon determines the play action on the board by the throw of the game piece. Markers are provided which are received in the apertures in the board to record the play action thereon, in accordance with the rules of baseball.

Other known prior art games include, for example, U.S. Pat. Nos. 5,129,651; 4,179,123 and 4,452,453.

The present invention advantageously improves upon the above as well as other prior art approaches.

SUMMARY OF THE INVENTION

The present invention advantageously addresses the needs above as well as other needs by providing a baseball card board game including a method for determining hits based on a number of baseball card lengths from a defensive baseball player card that a ball is when it comes to rest after being hit by an offensive player.

In one embodiment, the invention can be characterized as a method of playing a baseball game of a type having a game surface with a baseball diamond thereon, a plurality of player cards, a ball, and a bat. The method involves rolling the ball; swinging the bat; determining an out in the event the ball is hit by the bat against one of the player cards; determining a single base hit in the event the ball is not hit against one of the player cards, but rather is hit by the bat and comes to rest within a first predetermined distance of one of the player cards; determining a double base hit in the event the ball is not hit against one of the player cards, but rather is hit by the bat and comes to rest within a second predetermined distance of one of the player cards; and determining a triple base hit in the event the ball is not hit against one of the player cards, but rather is hit by the bat and comes to rest within a third predetermined distance of one of the player cards. The player card, as used herein, preferably includes a baseball player card (or baseball trading card) and preferably also includes a player card stand for holding the baseball player cards.

In particular variations, the method also involves determining the first predetermined distance by determining whether the ball comes to rest less than twice a length of a long edge of one of the player cards from the closest player card to the ball after the ball comes to rest; determining the second predetermined distance by determining whether the ball comes to rest less than three times a length of a long edge of one of the player cards from the closest player card to the ball after the ball comes to rest; and determining the third predetermined distance by determining whether the ball comes to rest less than four times a length of a long edge of one of the player cards from the closest player card to the ball after the ball comes to rest.

In further variations, the method also involves determining a home run in the event the ball is not hit against one of the player cards, but rather is hit by the bat and comes to rest within a fourth predetermined distance of one of said player cards, or determining a home run in the event the ball is hit through a gap between adjacent outfield wall sections.

In yet further variations, the method involves determining an error in the event the ball is hit by the bat against an error portion of one of said player cards, such that an out is determined in the event said ball is hit against a remaining portion (not the error portion) of one of the player cards.

In another embodiment, the present invention can be characterized as a method of determining an outcome in a baseball game by determining an out in the event a ball is hit against one of a plurality of player cards; and determining a hit in the event the ball is not hit against one of the player cards, but rather is hit and comes to rest within a predetermined distance of one of the plurality of player cards.

In a further embodiment, the present invention can be characterized as a baseball game employing a bat; a ball; a plurality of player cards, the baseball player cards including a baseball player card (or baseball trading card), and a player card stand, the baseball player card being separable from the player card stand to measure a number of baseball player card lengths from said player card stand that the ball comes to rest after being hit by the bat; and a game board including a baseball diamond thereon.

BRIEF DESCRIPTION OF THE DRAWINGS

The above and other aspects, features and advantages of the present invention will be more apparent from the following more particular description thereof, presented in conjunction with the following drawings wherein:

FIG. 1 is an illustration of a game board useable in one embodiment of the present invention;

FIG. 2 is a side view of a pitching tube useable with the game board of FIG. 1;

FIG. 3 is a top view of the pitching tube of FIG. 2;

FIG. 4 is the spring and bolt portion of the pitching tube of FIGS. 2 and 3;

Corresponding reference characters indicate corresponding components throughout the several views of the drawings.

DETAILED DESCRIPTION OF THE PREFERRED EMBODIMENTS

Figure 5:
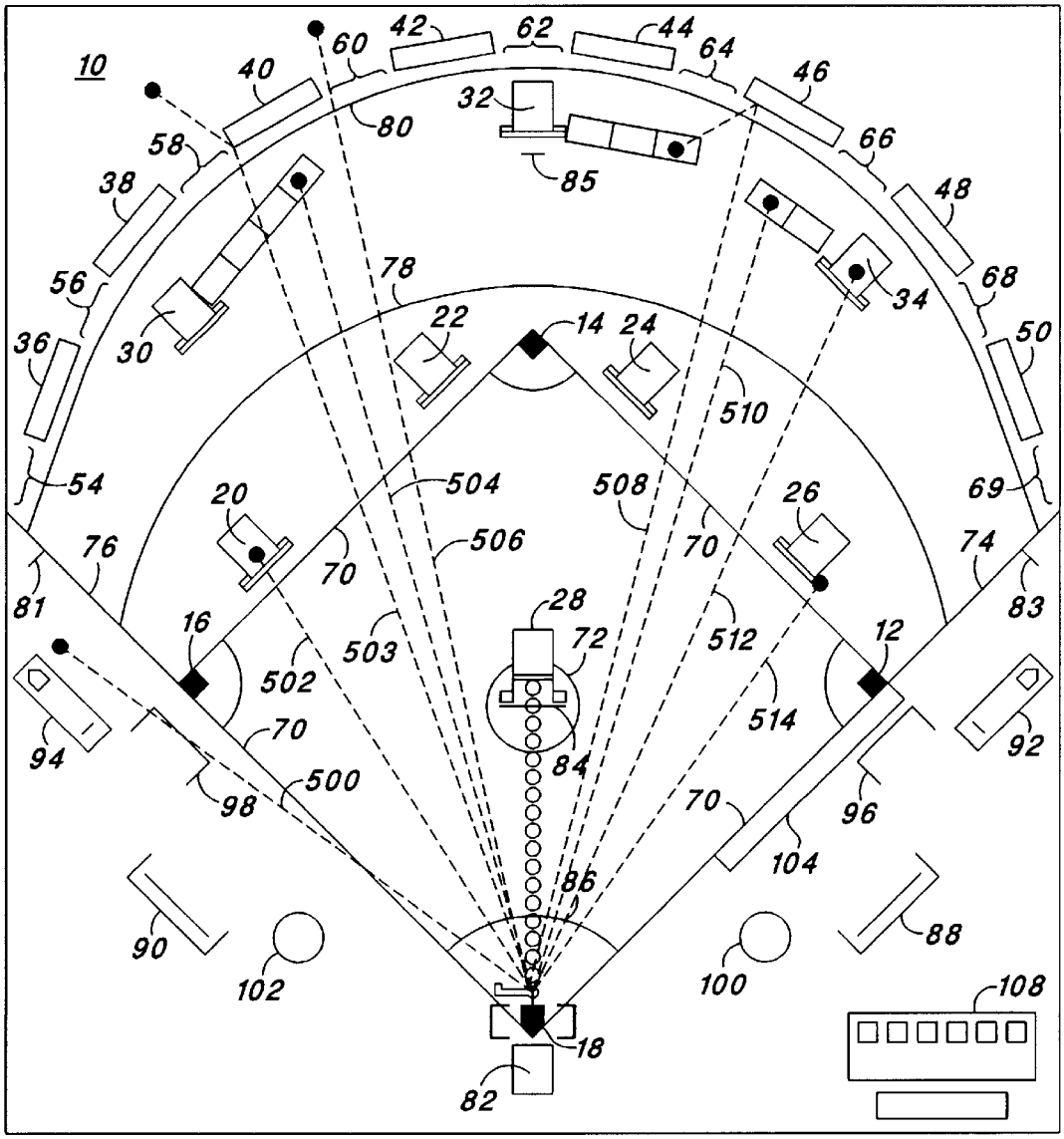
FIG. 5 is an illustration of the game board of FIG. 1 showing a method for determining hits.

The following description of the presently contemplated best mode of practicing the invention is not to be taken in a limiting sense, but is made merely for the purpose of describing the general principles of the invention. The scope of the invention should be determined with reference to the claims.

Referring first to FIG. 1, an illustration is shown of a game board useable in one embodiment of the present invention. Shown are the game board 10 three bases, first base 12, second base 14 and third base 16; a home plate 18; four infielder card stands 20, 22, 24, 26; a pitcher card stand 28; three outfielder card stands 30, 32, 34; and eight outfield wall (or fence) sections 36, 38, 40, 42, 44, 46, 48, 50;.

The bases 12, 14, 16 are 1 inch square, and the home plate 18 is in proportion to these. The infielder card stands 20, 22, 24, 26 are better illustrated in FIG. 8 and are 2½ to 3½ inches in width, by ¾ inches in height, by 2 inches in depth. When the infielder card stands are made 3½ inches wide, a ½ inch portion on each side is labeled with an "E", and any hit against such portions is deemed an error. The infielder card stands 20, 22, 24, 26 can be made of wood, plastic, or metal. The pitcher card stand 28 is better illustrated in FIG. 7 and is 2½ to 3½ inches in width, by 2½ inches in height, by 2 inches in depth, with an opening of 1¾ height, and 2 inches in width at its base, so as to accommodate the pitching tube shown in FIG. 2. When the pitcher card stand is made 3½ inches wide, a ½ inch portion on each side is labeled with an "E", and any hit against such portions is deemed an error. The pitcher card stand 28 can also be made of wood, plastic, or metal. The outfielder card stands are better illustrated in FIG. 8 and are 2½ inches in length by ¾ inches in height by 2 inches in width. The outfielder card stands are also made of wood, plastic, or metal. The outfield wall sections 36, 38, 40, 42, 44, 46, 48, 50 are 10 inches in width, by 1¾ inches in height, by ⅛ inches in depth. These can be made of wood, plastic, or metal. Gaps 54, 56, 58, 60, 62, 64, 66, 68, 69 between the outfield wall sections are about 2½ inches wide. Stands to hold outfield wall sections 36, 38, 40, 42, 44, 46, 48, 50 are 10 inches long, ⅞ inches in width and ¼ inches in height.

The game board 10 is made from, for example, felt, canvas, or other such material. The game board 10 is preferably in the form of a square of 68 inches on each side. Positioned closer to, and centered relative to one edge of the square is a baseball diamond 70 comprised, at each of four corners, of the three bases (first base 12, second base 14, and third base 16) and the home plate 18, which is on a corner of the diamond closest to the one edge of the square. The actual diamond dimension from the home plate 18, to the first base 12 and the third base 16 is 18 inches, with second base being behind a pitcher's mound 72 and located 18 inches from the first base 12 and the third base 16. The pitcher's mound 72 is 12 inches from the home plate 18 to its front section, and has a total diameter of 3½ inches.

There are two straight lines 74, 76 from the home plate 18 that pass along the outer edges of the first base 12 and the third base 16 that comprise the foul lines, i.e., a left field foul line 76 and a right field foul line 74, respectively. The foul lines 74, 76 are 45½ inches in length from the home plate 18 to their respective ends near where the outermost outfield wall sections 36, 50 are located. The two centermost outfield wall sections 42, 44 are 58 inches from the home plate 18.

Additional lines are also on the game board 10. First, from just beyond the third base 16 (back toward the left-most outfield wall section 36) to just beyond the first base 12 (back toward the right-most outfield wall section 50), there is an arcuate line 78 that is 5 inches behind the bases 12, 14, 16. This arcuate line 78 terminates on the right and left field foul lines 74, 76 and encompasses the baseball diamond 70 between the right and left field foul lines 74, 76. A region encompassed by this arcuate line 78 is defined as the infield, where the infield player card stands 20, 22, 24, 26, 28 are positioned. Second, from twenty-one inches beyond the third base 16 (back toward the left-most outfield wall section 36) to twenty-one inches beyond the first base 12 (back toward the right-most outfield wall section 50), there is an arcuate line 80. This arcuate line 80 terminates on the right and left foul lines 74, 76 and encompasses the baseball diamond 70 between the right and left field foul lines 74, 76 and the other arcuate line 78. A region encompassed by this arcuate line 80, but outside the other arcuate line 78, is defined as the outfield, where the outfield player card stands 30, 32, 34, are positioned. Third, eighteen inches back from the first base 12 and the third base 16, a pair of short lines 81, 83 extend from the respective foul lines 74, 76 toward respective edges of the game board 10. A third short line 85 is located eighteen inches behind the second base 14. If one is playing a full scale game, players are not allowed to place any of the outfield player card stands 30, 32, 34 closer to the infield than an outfield side of there short lines 81, 83, 85, but may position their outfielder player card stands 30, 32, 34 anywhere on the outfield side of the short lines 81, 83, 85. A player may position their infield player card stands 20, 22, 24, 26 anywhere from on the other arcuate line 78 up to the diamond 70.

A smaller scale game can be played for younger players who cannot reach the pitchers mound 72 to pitch the ball toward the batter at the home plate 18. In accordance with the smaller scale game, younger players may move the outfield wall sections 36, 38, 40, 42, 44, 46, into the short lines 81, 83, 85 after removing two outfield wall sections 48, 50 from the game board 10.

Two sets of lines designating dugouts 88, 90 are located outside the foul lines 74, 76 between the home plate 18 and the first and third bases 12, 16, respectively. Two sets of lines designating bullpens 92, 94 are located outside of the foul lines 74, 76 past the first and third bases 12, 16 respectively. There are two sets of lines designating coach's boxes 96, 98 located outside the foul lines 74, 76 near the first and third bases 12, 16, respectively. An on-deck circle 100, 102 is located near each dugout 88, 90 on an end closest to the home plate 18. Another line designating a running lane 104 starts halfway between the first base 12 and the home plate 18, running perpendicular to the foul line 74 for a short distance, and continuing parallel to the foul line 74 to the first base 12. The line designating the running lane 104 is 9 inches long. There is no running lane on the third base side of the baseball diamond 70.

Figures 6, 7, 8, 9, 10:
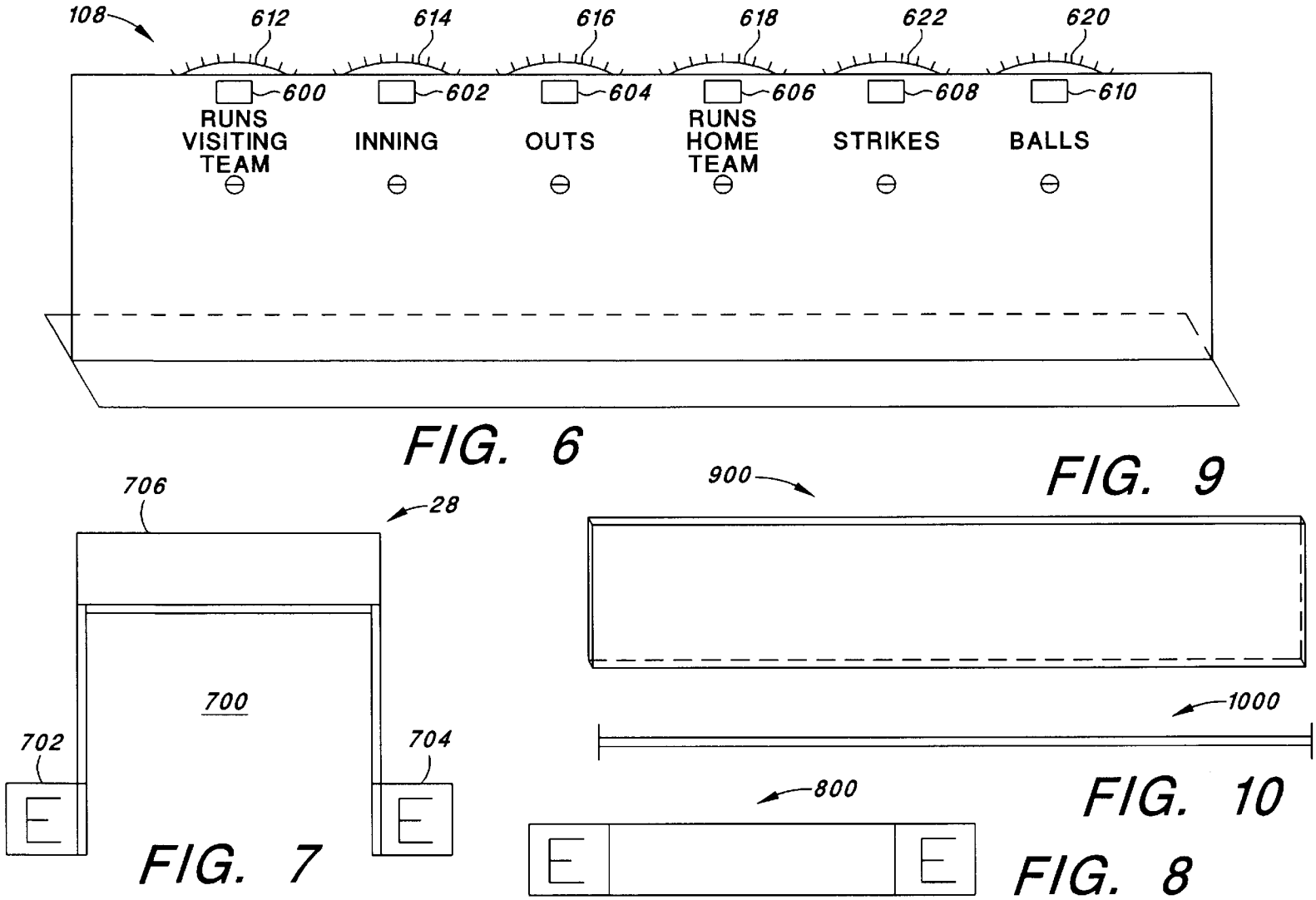
FIG. 6 is a front view of a scoreboard useable with the game board of FIG. 1.
FIG. 7 is a pitcher card stand useable with the game board of FIG. 1.
FIG. 8 is a fielder card stand useable with the game board of FIG. 1.
FIG. 9 is a front view of an outfield fence section useable with the game board of FIG. 1.
FIG. 10 is a top view of an outfield fence stand useable with the game board of FIG. 1.

A scoreboard 108, better illustrated in FIG. 6 is 15¾ inches in length, and 3¾ inches in height. The scoreboard 108 has 6 windows for runs for the visiting team, innings, outs, runs for the home team, balls, and strikes, respectfully.

In practice, each team fields nine players using baseball player cards with eight of the baseball trading cards being placed into the player card stands 20, 22, 24, 26, 28, 30, 32, 34 and one being placed behind the home plate 18 (designated the catcher), or optionally in an additional player card stand. The player card stands 20, 22, 24, 26, 28, 30, 32, 34 are positioned according to the player's positions on their baseball player cards, for example, in the major leagues. Line up sheets (such as are commonly used in baseball) are completed by batting order. A home team is selected and rolls or shoots the ball (not shown) toward the home plate 18 from the pitchers mound 72 to start play. Selection of the home team may be made by having each player roll the ball toward the outfield wall sections 36, 38, 40, 42, 44, 46, 48, 50 from the home plate 18 with the player who's roll comes the closest to the outfield wall sections 36, 38, 40, 42, 44, 46, 48, 50 without touching them being the home team. If two players are playing (which is a minimum), they alternate offense (batting) and defense (fielding) each half inning (after three outs against the offense).

If more than two players are playing, they rotate after each half inning as follows: a number 1 player will bat offense and a number 2 player will field defense; they switch each inning, with the number 3 player fielding defense, the number two player batting offense, etc.

Prior to starting play, the defensive player puts his or her players in their respective positions on the game board 10, including the catcher, which may or may not be in a player card stand.

The pitcher's card stand 28 may be used along with the pitching tube (see FIGS. 2 and 3). (The defensive player kneels behind the outfield wall sections 36, 38, 40, 42, 44, 46, 48, 50 when pitching). When used, the pitching tube is placed underneath an archway of the pitcher card stand 28 with the front of the pitching tube not closer to the home plate 18 than the line 84 on the pitcher's mound 72. To pitch the ball using the pitching tube, the ball is placed in front of a spring in the pitching tube, pulled back to a stop, and then released. When released, the ball is projected toward the home plate 18. Players may adjust the speed of the ball being pitched by adjusting a bolt within the pitching tube into slots on the top of the pitching tube so as to select the spring force applied to the ball when it is pulled back within the pitching tube. Alternatively, the slots may be omitted and the bolt held in place by the palm of the defensive player's hand while the ball is controlled by his or her fingertips.

The offensive player puts players at bat according to their batting order on the line up sheet. The offensive player must bat from the side of the home plate 18 from which the baseball player card says the player hits. For example, for a right handed batter, the offensive player must bat with the bat held on the right side of the home plate 18 (from the pitcher's perspective), for a left handed batter, the offensive player must bat with the bat held on the left hand side of the home plate 18 (from the pitcher's perspective), or for a switch hitter, the offensive player may bat with the bat held on either side of the home plate 18.

To bat, the offensive player holds a bat between his or her thumb and index finger while lying the bat on the gameboard 10. To hit the ball when pitched, the offensive player turns his or her fingers in a rotating fashion and flips the bat. The bat may not, in accordance with the present embodiment, be pushed at the ball, and the offensive player may not have the bat in front of the quarter-circle 86 at the home plate 18 when batting.

When the ball is hit, it must not touch a player card stand 20, 22, 24, 26, 28, 30, 32, 34 in the infield or outfield, or it is an out, unless it hits an error section of an infield player card stand 20, 22, 24, 26, 28, in which case the batter goes to the first base 12 and all runners advance one base. If the ball is hit and does not go through the infield or outfield, the closest player card stand 20, 22, 24, 26, 28, 30, 32, 34 to the ball has the play on the ball. To determine whether the hit is a base hit or an out, the baseball player card is removed from the baseball player card stand and flopped from the edge of the player card stand nearest the ball toward the ball, end to end. If the baseball player card touches the ball within one flop, the batter is out. If the baseball player card touches the ball within two flops, the batter advances to the first base 12, and any runners advance one base, with any runners reaching the home plate 18 scoring a run. If the baseball player card touches the ball within three flops, the batter advances to the second base 14, and any runners advance two bases with any runners reaching the home plate 18 scoring a run. If the baseball player card touches the ball within four flops, the batter advances to the third base 16 and all runners advance to the home plate 18 and score a run. If the baseball player card does not touch the ball within four flops, the batter advances to home plate 19 and scores a run and all runners advance to home plate 18 and score a run. (This is designated an inside-the-park home run.)

If the ball goes through the infield without touching an infield player card 20, 22, 24, 26, 28, it is at least a one base hit (a single). To determine if more than a one base hit is achieved, defensive player card 20, 22, 24, 26, 28, 30, 32, 34 closest to the ball will flop the baseball player card toward the ball, from the edge of the baseball player stand closest to the ball when it comes to rest. If the baseball player card touches the ball within two flops, the batter advances one base and any runners advance one base with any runners reaching the home plate 18 scoring a run. If the baseball player card touches the ball within three flops, the batter advances to the second base 14 and any runners advance two bases with any runners reaching the home plate 18 scoring a run. If the baseball player card touches the ball within four flops, the batter advances to the third base 16 and all runners advance to the home plate 18 and score a run. If the baseball player card does not touch the ball within four flops, the batter advances to the home plate 18 and scores a run, and all runners advance to the home plate 18 and score a run. (This is designated an inside-the-park home run.)

A standard sized marble, which is ⅝ inch in diameter, is used for the ball. The ball can be made of ceramic, wood, or plastic.

If the ball rolls against one of the outfield wall sections 36, 38, 40, 42, 44, 46, 48, 50, the closest player card stand 20, 22, 24, 26, 28, 30, 33, 34, to the ball when it comes to rest determines the type of hit, based on the number of card flops from the player card stand 20, 22, 24, 26, 28, 30, 32, 34, when the ball comes to rest. If the ball rolls against one of the outfield wall sections 36, 38, 40, 42, 44, 46, 48, 50, continues rolling, and passes between two of the outfield wall sections 36, 38, 40, 42, 44, 46, 48, 50, the hit is designated a two base hit, or double (i.e., ground rule double). In this instance, the batter goes to the second base 14 and other runners advance two bases. If the ball rolls between two of the outfield wall sections 30, 38, 40, 42, 44, 46, 48, 50 or past one of the outermost outfield wall sections 36, 50, without touching one of the outfield wall sections 36, 38, 40, 42, 44, 46, 48, 50, the batter advances to the home plate 18 and scores a run, and all runners advance to home plate 18 and score a run. (This is an over-the-wall home run.)

If the ball passes first base 12 or third base 16 while inside the respective foul line 74, 76, and then rolls over the foul line, i.e., into foul territory, the ball is deemed fair. If the ball crosses the respective foul line 74, 76 between the home plate 18 and the first base 12 or the third base 16, the ball is foul and handled, as in Major League Baseball, i.e., is counted as a strike, unless there are already two strikes against the batter during the present at bat, in which case the foul ball is not counted as a ball, strike or out.

When three outs are made against a batting player, the players switch between batting and fielding. Each player bats and fields once per inning. Nine innings are played unless the score is tied after both players have finished batting in the ninth inning, in which case the game continues until one player leads after both players have batted during an inning. The player with the most runs at the end of the game wins the game.

Referring next to FIG. 2, a side view is shown of a pitching tube 200 useable with the game board 10. A tube body 202 is cylindrical in shape with an outer diameter of about ¾ inches and an inner diameter of just larger than about ⅝ inches, so as to accommodate the ⅝ inch diameter of the ball 204. The tube body is about 5 inches in length and may be made from PVC. A slot 206 at one end of the tube body accommodates the ball 204, while a bolt 208 protrudes from the other end. The spring 210 is affixed within the tube body 202 to the bolt 208 with a screw.

Referring to FIG. 3, a top view is shown of the pitching tube 200. Shown is the tube body 202, the slot 206, and the bolt 208. Also shown is a channel 300 in which the bolt 208 may be secured with an appropriate screw. Optionally, the channel includes three slots 302, 304, 306 into which the screw may be diverted to as to hold the bolt 208 in place providing different spring tensions when the ball 204 (FIG. 2) is pulled back against the spring 210 (FIG. 2). Alternatively, the slots 302, 304, 306 may be omitted and the bolt 208 held in place by the palm of the defensive player's hand in order to provide an ultimate range of spring tensions.

The channel 300 is preferably 1 3/16 inches in length with the first two slots 302, 304 being ⅜ apart and the first and third slots 302, 306 being 11/16" apart. The first slot 302 at an end of the channel closes to the slot 206 in which the ball 204 (FIG. 2) is positioned.

The slot 206 in which the ball 204 (FIG. 2) is accommodated is about 1½ inches long, and the channel 300 is about 3½ inches from an end of the pitching tube at which the slot 206 is located.

Referring to FIG. 4, a view is shown of the spring 210 and bolt 208 portion of the pitching tube 200. Shown is the bolt 208 and the spring 210. Also shown is the screw 400 that holds the spring 210 to the bolt 208, and the screw 402 that holds the bolt 208 in the channel 300. The bolt is approximately 3½ inches in overall length, with a head portion 404 being approximately ¾ of an inch in length and a shaft portion 406 being approximately 2¾ inches in length. The screw 402 that holds the bolt head in the channel 300 is approximately ½ inch from an end of the bolt 208 at which the spring 210 is affixed. The outer diameter of the bolt head is ¾ of an inch, and the outer diameter of the bolt shaft is ⅝ inches.

Referring to FIG. 5, an illustration is shown of the game board 10 showing a method for determining hits. Shown are the first base 12, the second base 14, the third base 16 and the home plate 18, forming the diamond 70. Also shown is the pitcher's mound 72, the line on the pitcher's mound 84, the infield player card strands 20, 22, 24, 26, the outfield player card stands 30, 32, 34, and the pitcher player card stand 28. The foul lines 74, 76, the arcuate line 80 and the other arcuate line 78, are also shown. Beyond the arcuate line 80 shown are the outfield wall sections 36, 38, 40, 42, 44, 46, 48, 50. Also shown are the short lines behind which the outfield player card stands 30, 32, 34, must be placed and other features, such as the running lane 104, the dugouts 88, 90, the bullpens, 92, 94, the coaches boxes 96, 98, the on-deck circles 100, 102, the catcher 82 and the scoreboard 108. In front of the homeplate 18 is shown the arcuate line 86, which the batter must bat.

Also shown in FIG. 5 is a first dashed line 500 showing a foul ball, as a result of the ball crossing the foul line 76 before passing the third base 16; a second dashed line 502 depicting an out as a result of the ball rolling against an infield player card stand 20; a third dashed line 503 showing a ground rule double as a result of the ball passing through the gap 58 between adjacent outfield wall sections 38, 40 after having been bounced off an end of one or the outfield wall sections 40; a fourth dashed line 504 depicting a triple as a result of the ball coming to rest within four card flops of the nearest player card stand 30; a fifth dashed line 506 depicting a homerun as a result of the ball passing through the gap 62 between adjacent outfield wall sections 42, 44; a sixth dashed line 508 depicting a double as a result of the ball coming to rest within three card flops of the nearest player card stand 32 after having been bounced off of one of the outfield wall sections 46; a seventh dashed line 510 depicting a single as a result of the ball coming to rest within two flops of the nearest player card stand 34; an eighth dashed line 512 representing an out as a result of the ball rolling against one of the outfield player card stands 34 and a ninth dashed line 514 representing an error as a result of the ball rolling against an error portion of one of the infield player card stands 26. A further description of each of the outcomes presented by the dotted lines 500, 502, 504, 506, 508, 510, 512, 514 are described in further detail hereinabove with reference to FIG. 1.

Referring to FIG. 6, a front view is shown of a scoreboard 108 useable with the game board 10. Shown are the windows indicating runs for the visiting team 600, inning 602, outs 604, runs for the home team 606, balls 608 and strikes 610. The scoreboard has a length of 15¾ inches and height of 3¾ inches, with the base having a width of 1½ inches. Thumbwheels 612, 614, 616, 618, 620, 622 are attached with a nut and machine screw, or rivets and have numbers imprinted on them appropriate to the window 600, 602, 604, 606, 608, 610 through which such numbers show. The runs for the visiting team window 600 and the runs for the home team window 606 have the numbers 0 through 23 on them in the preferred embodiment. The thumbwheel 614 for the inning window 602 has the numbers 1 through 11 imprinted on it. The thumbwheel 616 for the outs window 604 has the numbers 0 through 3 on it, the thumbwheel 620 for the balls window 608 has the numbers 0 through 4 on it, and the thumbwheel 622 for the strikes window 610 has the numbers 0 through 3 on it.

Referring to FIG. 7, a pitcher card stand 28 is shown useable with the game board 10. The pitcher card stand 28 has an exterior height of 2½ inches, and an overall width of 3⅛ inches. An internal arch 700 has a height of 1¾ inches and a width of approximately 2 inches, so as to accommodate the pitching tube 200. Error portions 702, 704, protrude approximately ½ inch on each side of the arch 700, and have a height of about ½ inch. A slot at a top edge 706 of the pitcher card stand 28 accommodates a baseball player card.

Referring to FIG. 8, an infield player card stand 800 is shown useable with the game board 10. The infield player card stand 20 is similar in width to the pitcher player card stand 28, i.e., an over width of 2½ to 3½ inches, depending on whether the error portions are included, but lacks the arch 700 (FIG. 7) of the pitcher player card stand 28. The error portions are employed preferably on the infielder player card stands, whereas they are omitted in the preferred embodiment from the outfield player card stands. As depicted in FIG. 8, the error portions are shown in dashed lines.

Referring to FIG. 9, a front view is shown of an outfield wall section 900 useable with the game board 10. Preferably, the outfield wall section has an overall width of 10 inches, and a height of 1¾ inches.

Referring to FIG. 10, a top view is shown of an outfield fence stand 1000 useable with the game board 10. Preferably, the outfield fence stand 1000 has an overall length of 10 inches, and a width of ⅞ inches.

Figure 11:
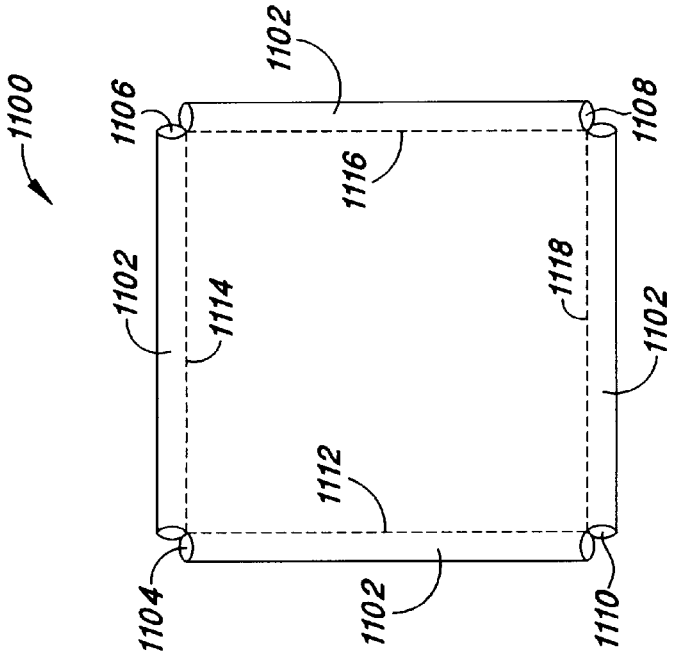
FIG. 11 is a top view of a game board of another embodiment in which sleeves along edges of the game board for accommodating respective tensioning battens.

Referring to FIG. 11, a top view is shown of a game board 1100 of another embodiment in which sleeves 1102 are shown along edges of the game board for accommodating respective tensioning battens. Shown are a plurality of sleeves 1104, 1106, 1108, 1110, along each edge of the game board 1100. These sleeves are formed by sewing such sleeves at a stitch line 1112, 1114, 1116, 1118, as depicted using a dashed line. The sleeves are preferably 2 inches in width and have an opening at each end thereof for accommodating tensioning batten.

Figure 12:
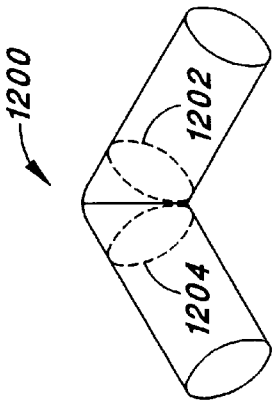
FIG. 12 is a top view of a corner bracket useable with the game board of FIG. 11.

Referring to FIG. 12, a top view is shown of a corner bracket 1200 useable with the game board 10. The corner bracket 1200 includes a fiberglass reinforced plastic shell in which square stop plugs 1202, 1204 are positioned for receiving and holding the tensioning battens.

Figure 13:
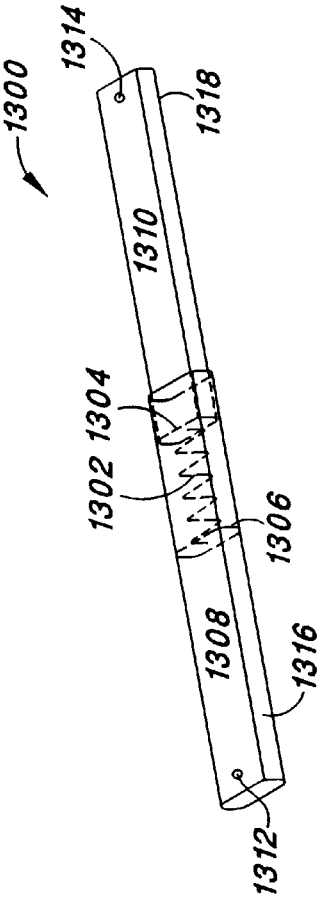
FIG. 13 is a top view of a tensioning batten of a type useable with the game board of FIG. 11.

Referring to FIG. 13, a top view is shown of a tensioning batten of a type useable with the game board 10. The battens may be made of wood, metal or high strength plastic and may alternatively be replaced by off-the-shelf drapery rods that are suitably flat and adjustable. A spring maintains the tension in the batten, and is held in place by an adhesive. A retainer 1306 in the first half 1308 of the batten holds against the spring, which is affixed to a second half 1310 of the batten. Holes 1312, 1314 accommodated a key that can be used to compress the spring during the insertion of respective ends 1316, 1318 of the batten into respective corner brackets during assembly prior to use.

Figure 14:
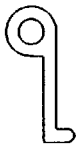
FIG. 14 is a side view of a key useable for inserting the tensioning batten of FIG. 13 into the corner bracket of FIG. 12.

Referring to FIG. 14, a side view is shown of a key useable for inserting the tensioning batten 1300 into the corner bracket 1200.

While the invention herein disclosed has been described by means of specific embodiments and applications thereof, numerous modifications and variations could be made thereto by those skilled in the art without departing from the scope of the invention set forth in the claims.

What is claimed is:

1. A method of determining an outcome in a baseball game comprising:

determining an out in the event a ball is hit against one of a plurality of player cards after the ball has made contact with a swinging bat; and determining a hit in the event the ball is not hit against one of the player cards, but rather is hit and comes to rest within a predetermined distance of one of the plurality of player cards, the plurality of player cards being positioned on a game surface with a baseball diamond thereon;

wherein said determining of said hit includes:

determining a single base hit in the event the ball is not hit against one of the player cards, but rather is hit by the bat and comes to rest within a first predetermined distance of one of the player cards;

determining a double base hit in the event the ball is not hit against one of the player cards, but rather is hit by the bat and comes to rest within a second predetermined distance of one of the player cards; and determining a triple base hit in the event the ball is not hit against one of the player cards, but rather is hit by the bat and comes to rest within a third predetermined distance of one of the player cards.

2. The method of claim 1 further comprising:

determining said out in the event the ball is not hit against one of the player cards, but rather is hit by the bat and comes to rest within a fourth predetermined distance of one of the player cards, wherein the one of the player cards is in an infield and wherein said first predetermined distance is larger than said fourth predetermined distance.

3. The method of claim 2 wherein:

said fourth predetermined distance is less than a length of an edge of one of said player cards.

4. A method of determining an outcome in a baseball game comprising:

determining an out in the event a rolling ball is hit against one of a plurality of player cards after the ball has made contact with a swinging bat;

determining a single base hit in the event the ball is not hit against one of the player cards but rather is hit by the bat and comes to rest within a first predetermined distance of one of the player cards;

determining a double base hit in the event the ball is not hit against one of the player cards, but rather is hit by the bat and comes to rest within a second predetermined distance of one of the player cards, wherein said second predetermined distance is larger than said first predetermined distance;

determining a triple base hit in the event the ball is not hit against one of the player cards, but rather is hit by the bat and comes to rest within a third predetermined distance of one of the player cards, wherein said third predetermined distance is larger than said second predetermined distance;

determining a home run in the event said ball is not hit against one of said player cards, but rather is hit by said bat and comes to rest within a fourth predetermined distance of one of said player cards, wherein said fourth predetermined distance is larger than said third predetermined distance;

determining a home run in the event said ball is not hit against one of said player cards, but rather is hit through a gap between adjacent outfield wall sections;

determining an error in the event said ball is hit by said bat against an error portion of one of said player cards; and determining said out in the event the ball is not hit against one of the player cards, but rather is hit by the bat and comes to rest within a fifth predetermined distance of one of the player cards; wherein the one of the player cards is in an infield and wherein said first predetermined distance is larger than said fifth predetermined distance.

5. A method of determining an outcome in a baseball game comprising:

determining an out in the event a ball is hit against one of a plurality of player cards;

determining a hit in the event the ball is not hit against one of the player cards, but rather is hit and comes to rest within a predetermined distance of one of the plurality of player cards; further comprising:

determining said out in the event the ball is not hit against one of the player cards but rather is hit and comes to rest within a second predetermined distance of one of the player cards; wherein the one of the player cards is in an infield and wherein said predetermined distance is larger than said second predetermined distance.

* * * * *